US010347974B1

(12) United States Patent
Palmer et al.

(10) Patent No.: US 10,347,974 B1
(45) Date of Patent: Jul. 9, 2019

(54) DEPLOYABLE BICONICAL RADIO FREQUENCY (RF) SATELLITE ANTENNA AND RELATED METHODS

(71) Applicant: Eagle Technology, LLC, Melbourne, FL (US)

(72) Inventors: Edward G. Palmer, Indialantic, FL (US); Francis E. Parsche, Palm Bay, FL (US); Alan W. Mast, Melbourne Beach, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 15/880,888

(22) Filed: Jan. 26, 2018

(51) Int. Cl.
*H01Q 1/28* (2006.01)
*H01Q 1/12* (2006.01)
*H01Q 9/28* (2006.01)

(52) U.S. Cl.
CPC ..... *H01Q 1/288* (2013.01); *H01Q 1/1235* (2013.01); *H01Q 9/28* (2013.01)

(58) Field of Classification Search
CPC ..... H01Q 9/16; H01Q 1/50; H01Q 21/062; H01Q 1/288; H01Q 1/1235; H01Q 9/28
See application file for complete search history.

(56) References Cited

U.S. PATENT DOCUMENTS 4,030,101 A 6/1977 Satoh
4,131,897 A 12/1978 Gaunt
4,358,773 A 11/1982 Staub, Jr. et al.
4,772,894 A 9/1988 Foissac et al.
4,835,542 A 5/1989 Sikina, Jr.
5,142,861 A 9/1992 Schlicher et al.
(Continued)

FOREIGN PATENT DOCUMENTS

EP 3418204 A1 * 12/2018 ..... B64G 1/1007
WO WO1999014817 8/2000
WO WO2017070139 4/2017

OTHER PUBLICATIONS

Kaleva Design Inc. http://www.kalevadesign.com/ retreived from internet Sep. 19, 2017: pp. 2.
(Continued)

*Primary Examiner* — Dameon E Levi
*Assistant Examiner* — David E Lotter
(74) *Attorney, Agent, or Firm* — Allen, Dyer, Doppelt + Gilchrist, P.A. Attorneys at Law

(57) ABSTRACT

A radio frequency (RF) satellite antenna may include an antenna housing to be carried by the satellite and having first and second opposing antenna element storage compartments. The antenna may further include a first plurality of self-deploying conductive antenna elements moveable between a first stored position within the first antenna element storage compartment, and a first deployed position extending outwardly from the canister and defining a first conical antenna. The antenna may also include a second plurality of self-deploying conductive antenna elements moveable between a second stored position within the second antenna element storage compartment, and a second deployed position extending outwardly from the canister and defining a second conical antenna. The first and second conical antennas may extend in opposing directions and defining a biconical antenna when in the first and second deployed positions.

21 Claims, 14 Drawing Sheets

(56) References Cited

U.S. PATENT DOCUMENTS

| | | | | |
|---|---|---|---|---|
| 5,233,362 | A | 8/1993 | Villaseca et al. | |
| 5,493,771 | A | 2/1996 | Sinha et al. | |
| 5,608,416 | A | 3/1997 | Champion et al. | |
| 5,874,924 | A * | 2/1999 | Csongor | H01Q 1/288 343/789 |
| 6,486,849 | B2 | 11/2002 | Buckles | |
| 6,791,510 | B2 | 9/2004 | Watanabe et al. | |
| 6,822,621 | B2 | 11/2004 | Lamour et al. | |
| 6,953,619 | B2 | 10/2005 | Dean et al. | |
| 7,286,100 | B1 | 10/2007 | McGinley, Jr. | |
| 7,501,824 | B2 | 3/2009 | Kawachi et al. | |
| 7,538,743 | B1 | 5/2009 | Chantz | |
| 7,965,488 | B2 | 6/2011 | Kaufman | |
| 8,253,636 | B2 | 8/2012 | Gardner et al. | |
| 8,289,224 | B2 | 10/2012 | Halkiopoulos | |
| 8,599,098 | B1 | 12/2013 | Marshall | |
| 8,730,118 | B1 | 5/2014 | McLean | |
| 2014/0028532 | A1 | 1/2014 | Ehrenberg et al. | |

OTHER PUBLICATIONS

AMETEK sensors, test & calibration http://www.hunterspringandreel.com/products/stacers: retreived from internet Sep. 19, 2017; pp. 3.

Hybrid Antenna System: https://www.isispace.nl/product/antennas/ retrieved from Internet Sep. 19, 2017; pp. 2.

Ochoa, et al. "Deployable Helical Antenna for Nano-Satellites" http://www.northropgrumman.com/BusinessVentures/AstroAerospace/Documents/pageDocs/tech_papers/SmallSat_DeployableHelical_ochoa_SSC14-IX-4.pdf: 28th annual AFAA/USU Conference on Small Satellites; 2014; pp. 7.

Constantine et al. "UHF deployable antenna structures for CubeSats" Radio Science Meeting (USNC-URSI NRSM), 2014 United States National Committee of URSI National pp. 3. Abstract Only.

Murphey et al. "Deployable Booms and Antennas Using Bi-stable Tape-springs" http://digitalcommons.usu.edu/cgi/viewcontent.cgi?article=1241&context=smallsat; 24th Annuial AIAA/USU; 2010; pp. 7.

Kakoyiannis et al. "Electrically Small Microstrip Antennas Targeting Miniaturized Satellites: the CubeSat Paradigm" Microstirp Antennas; 2011; pp. 44. https://www.intechopen.com/.../microstrip-antennas/electrically-small-microstrip-antenna . . . .

"cubesat turnstile antenna material selection" https://ham.stackexchange.com/questions/6750/cubesat-turnstile-antenna-material-selection: retrieved from Internet Sep. 19, 2017; pp. 3.

Harris Corp. "CA-3597 Broadband biconical BHF/UHF dipole antenna" https://www.harris.com/sites/default/files/antenna-ca-3597.pdf; retrieved from internet Jan. 26, 2018; pp. 2.

* cited by examiner

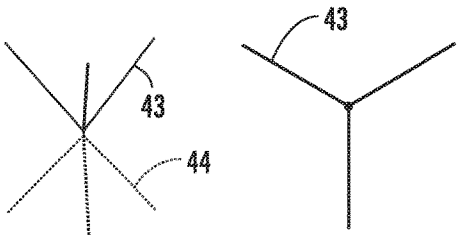
FIG. 10A
FIG. 10B
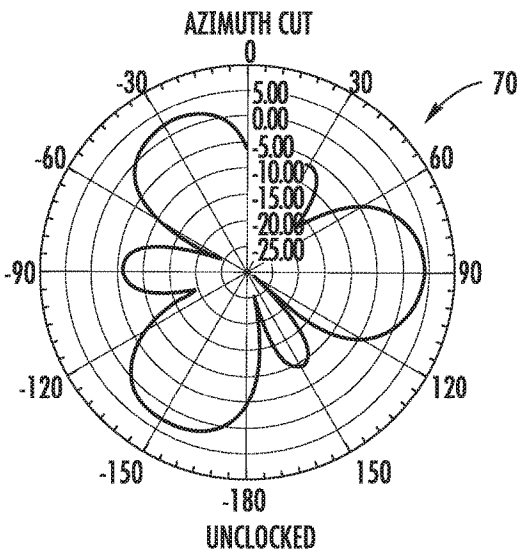
FIG. 10C
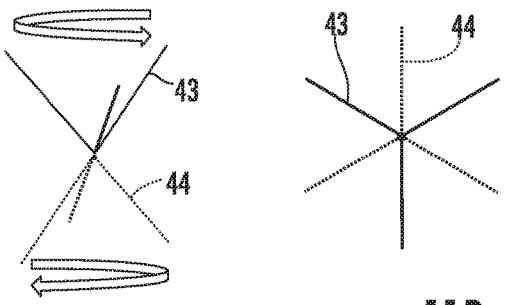
FIG. 11A
FIG. 11B
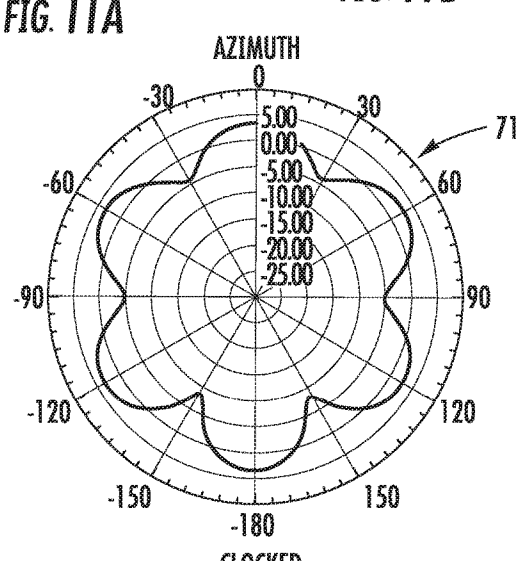
FIG. 11C

DEPLOYABLE BICONICAL RADIO FREQUENCY (RF) SATELLITE ANTENNA AND RELATED METHODS

GOVERNMENT RIGHTS

This invention was made with government support under classified government contract. The government has certain rights in the invention.

TECHNICAL FIELD

The present invention relates to RF communications systems, and more particularly, to satellite communication systems and related methods.

BACKGROUND

Deployable antennas are desirable in satellite and other space applications. In such applications, it is important for an antenna to be able to fit into a small space, but also be expandable to a fully operational size once orbit has been achieved.

The issue of antenna deployability is particularly important as the size of satellites gets smaller. While the sensors and operating electronics of miniaturized satellites may be scaled to extremely small volumes, the wavelengths of the signals used by such miniaturized satellites to communicate do not scale accordingly. Given that the wavelength of a signal determines the size of an antenna used to communicate that signal, antennas for miniaturized satellites still need to have dimensions similar to those of larger satellites. Moreover, it is desirable to use such satellites over as wide of a signal spectrum as possible.

One approach for a space deployable antenna is disclosed in U.S. Pat. No. 6,791,510 where the antenna includes an inflatable structure, a plane antenna supported by the inflatable structure and a plurality of tensioning cables for supporting the plane antenna with the inflatable structure. When the antenna is initially placed in a satellite that is to be launched, the plane antenna and the inflatable structure are both stored inside a rocket fairing in their rolled or folded states. After the rocket is launched and the antenna is set on its satellite orbit, a gas or a urethane foam is filled into the inflatable structure to deploy the inflatable structure to its shape. The plane antenna, which is in the rolled or folded state, is extended and the tensioning cables pull uniformly on the membrane surface periphery of the plane antenna to extend it into a flat plane without distortions.

Yet another approach for an inflatable antenna is disclosed in U.S. published patent application no. 2014/0028532. The inflatable antenna includes an inflatable dish with a RF reflective main reflector and an opposing RF transparent dish wall. An inflatable RF transparent support member and an RF reflective subreflector extend from the dish wall. When the antenna is inflated, the main reflector and the subreflector oppose each other to reflect RF energy toward each other to form an antenna. A gas or a hardening foam may be used to fill the inflatable antenna.

Despite the existence of such structures, further advancements may be desirable in certain applications to facilitate satellite antenna deployment and achieve desired operating characteristics.

SUMMARY

A radio frequency (RF) satellite antenna may include an antenna housing to be carried by the satellite and having first and second opposing antenna element storage compartments. The antenna may further include a first plurality of self-deploying conductive antenna elements moveable between a first stored position within the first antenna element storage compartment, and a first deployed position extending outwardly from the canister and defining a first conical antenna. The antenna may also include a second plurality of self-deploying conductive antenna elements moveable between a second stored position within the second antenna element storage compartment, and a second deployed position extending outwardly from the canister and defining a second conical antenna. The first and second conical antennas may extend in opposing directions and define a biconical antenna when in the first and second deployed positions.

More particularly, the first plurality of antenna elements may each include a first metallic tape segment, and the second plurality of antenna elements may each include a second metallic tape segment, for example. In accordance with another example, the antenna may further include a first removable cover associated with the first antenna element storage compartment, and a second removable cover associated with the second antenna element storage compartment. Additionally, the first and second conical antennas may be rotationally offset with respect to one another, for example.

In one example implementation, the antenna may further include a first conductive feed cone coupled to the first plurality of antenna elements at a first apex, and a second conductive feed cone coupled to the second plurality of antenna elements at a second apex. Furthermore, a balun may be coupled to the first and second conductive feed cones. In one example implementation, a mast mounting flange may be coupled to the antenna housing. By way of example, the first plurality of antenna elements may include at least three first antenna elements, and the second plurality of antenna elements may also include at least three second antenna elements.

A satellite is also provided which may include a satellite housing having an antenna storage compartment therein, RF circuitry carried by the satellite housing, and a mast having a proximal end coupled to the satellite housing and a distal end. The mast may be moveable between a stored position where the distal end is within the antenna storage compartment, and a deployed position where the distal end is spaced apart from the satellite housing. The satellite may further include an RF satellite antenna, such as the one described briefly above, coupled to the RF circuitry and the mast and carried within the antenna storage compartment.

A related method is for making an RF satellite antenna, such as the one described briefly above. The method may include, in an antenna housing to be carried by a satellite and including first and second opposing antenna element storage compartments, installing a first plurality of self-deploying conductive antenna elements moveable between a first stored position within the first antenna element storage compartment, and a first deployed position extending outwardly from the canister and defining a first conical antenna. The method may further include installing a second plurality of self-deploying conductive antenna elements moveable between a second stored position within the second antenna element storage compartment, and a second deployed position extending outwardly from the canister and defining a second conical antenna. The first and second conical antennas may extend in opposing directions and define a biconical antenna when in the first and second deployed positions.

BRIEF DESCRIPTION OF THE DRAWINGS

FIGS. 10(*a*)-10(*b*) are side and top views, respectively, of a biconical antenna configuration in accordance with an example implementation without element clocking, and FIG. 10(*c*) is the corresponding simulated radiation pattern.

FIGS. 11(*a*)-11(*b*) are side and top views, respectively, of a biconical antenna configuration in accordance with an example implementation with element clocking, and FIG. 11(*c*) is the corresponding simulated radiation pattern.

DETAILED DESCRIPTION OF THE EMBODIMENTS

Figure 1:
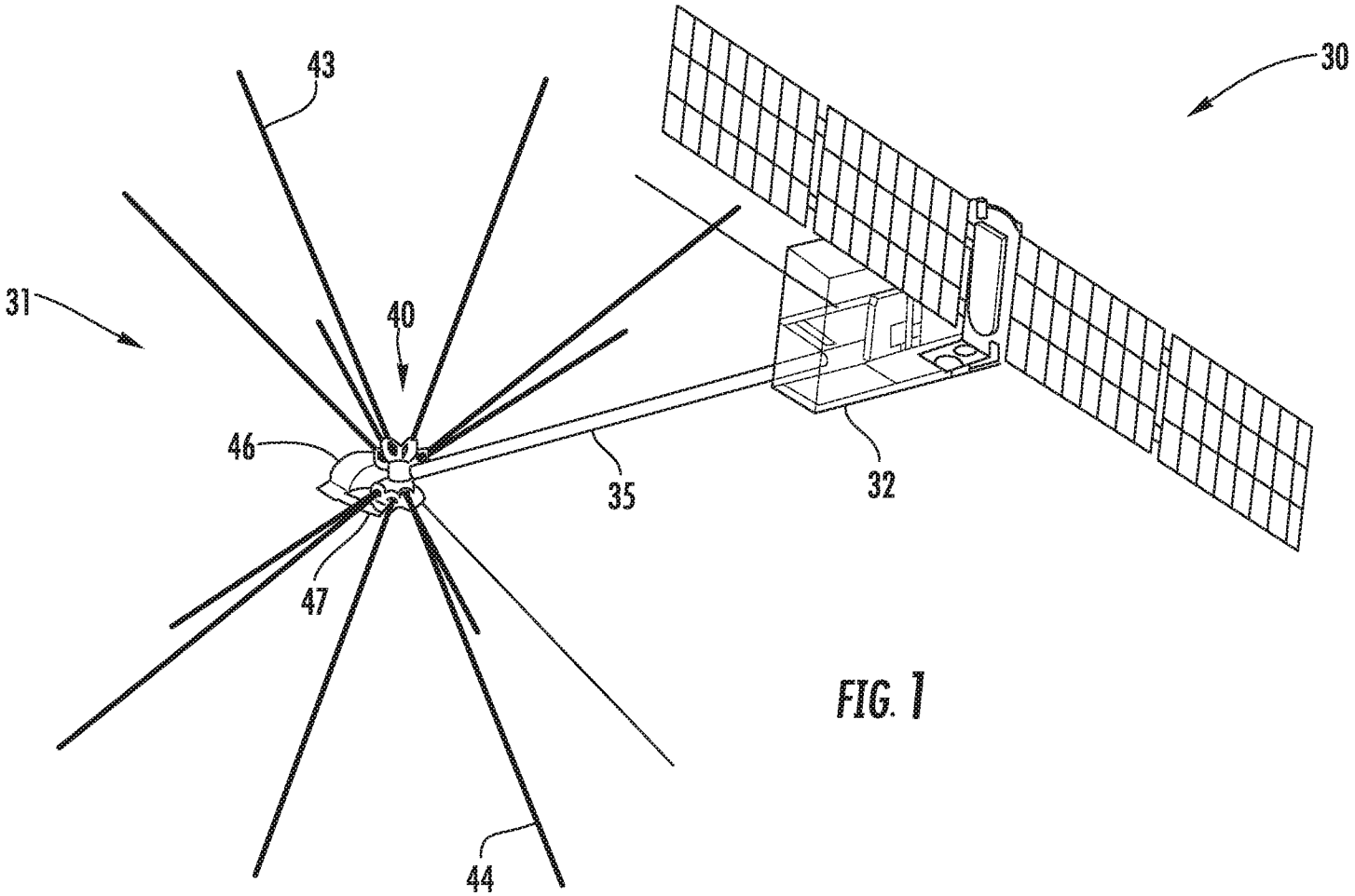
FIG. 1 is a perspective view of a satellite including a stowable bi-conical antenna in accordance with an example embodiment.

The present description is made with reference to the accompanying drawings, in which exemplary embodiments are shown. However, many different embodiments may be used, and thus the description should not be construed as limited to the particular embodiments set forth herein. Rather, these embodiments are provided so that this disclosure will be thorough and complete. Like numbers refer to like elements throughout.

Referring initially to FIGS. 1-9, a satellite 30 illustratively includes a stowable or storable radio frequency (RF) antenna 31. The satellite illustratively includes a satellite housing 32 having an antenna storage compartment 33 therein, RF circuitry 34 (e.g., transmitter, receiver, etc.) carried by the satellite housing, and an extendable mast 35 having a proximal end coupled to the satellite housing and a distal end coupled to an antenna housing 40 of the antenna 31. The mast 35 may be moveable (e.g., telescopic) between a stored position where the distal end is within the antenna storage compartment 33, and a deployed position where the distal end is spaced apart from the satellite housing 32 (shown in FIG. 1).

Figure 2:
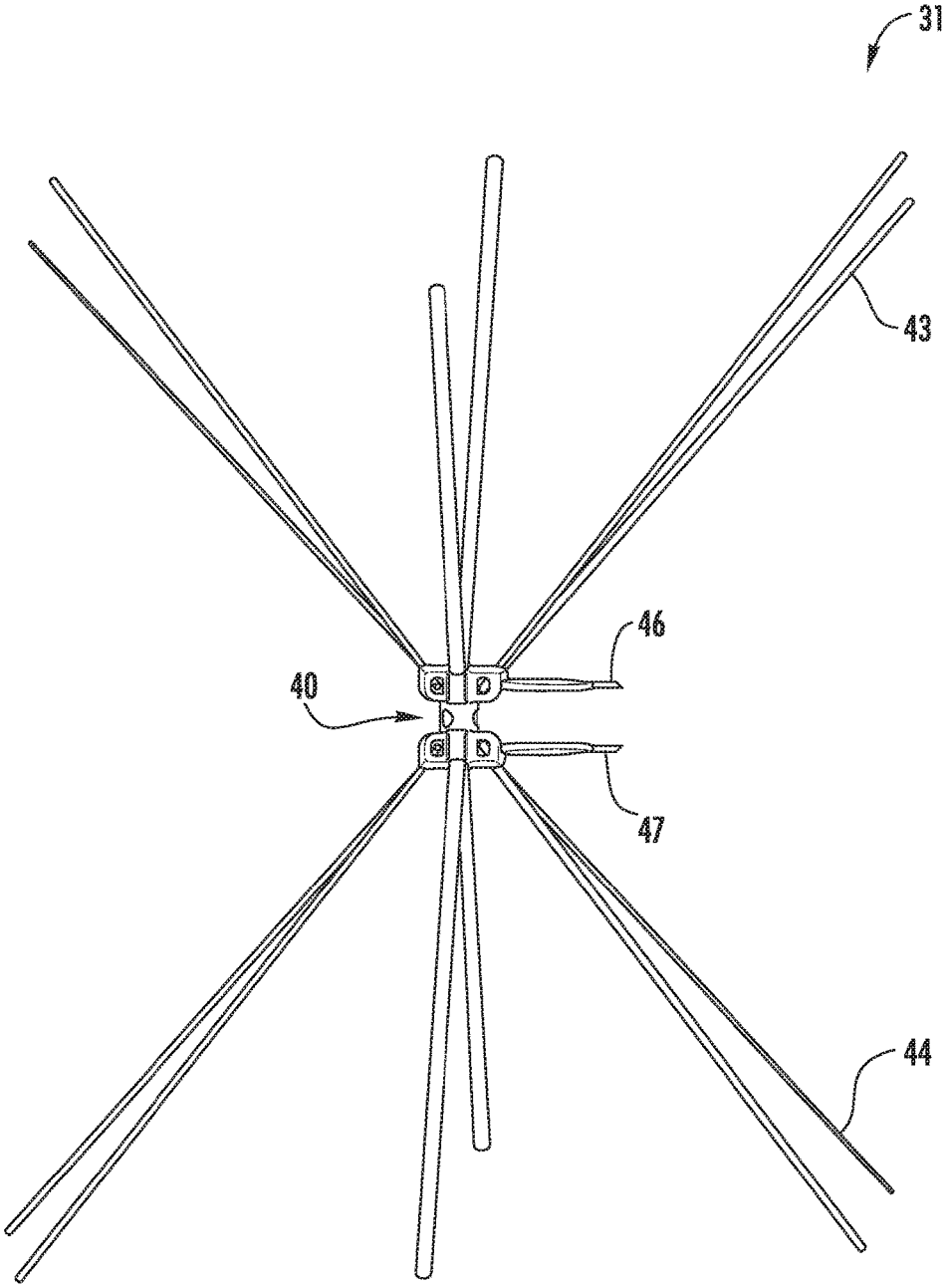
FIG. 2 is a perspective view of the antenna of FIG. 1 in a deployed position.
Figure 3:
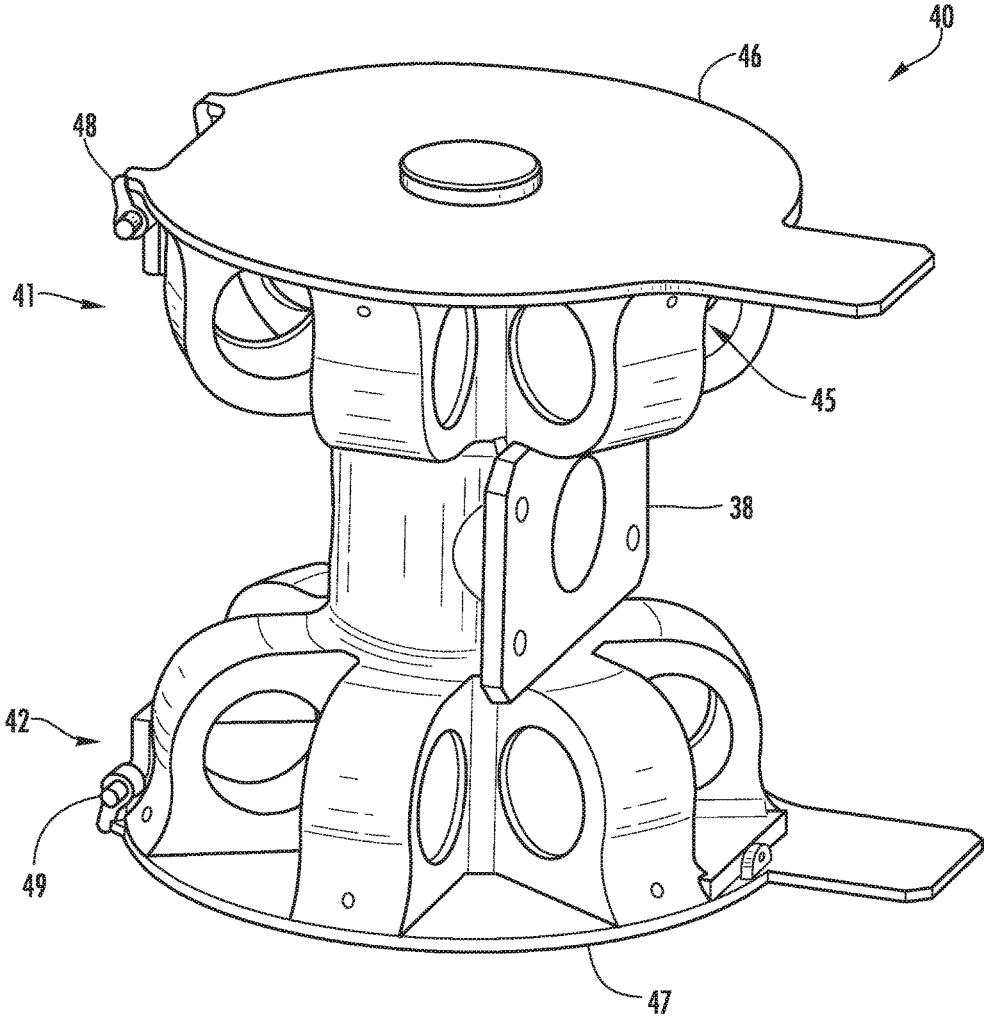
FIG. 3 is a perspective view of the housing of the antenna of FIG. 2.
Figure 4:
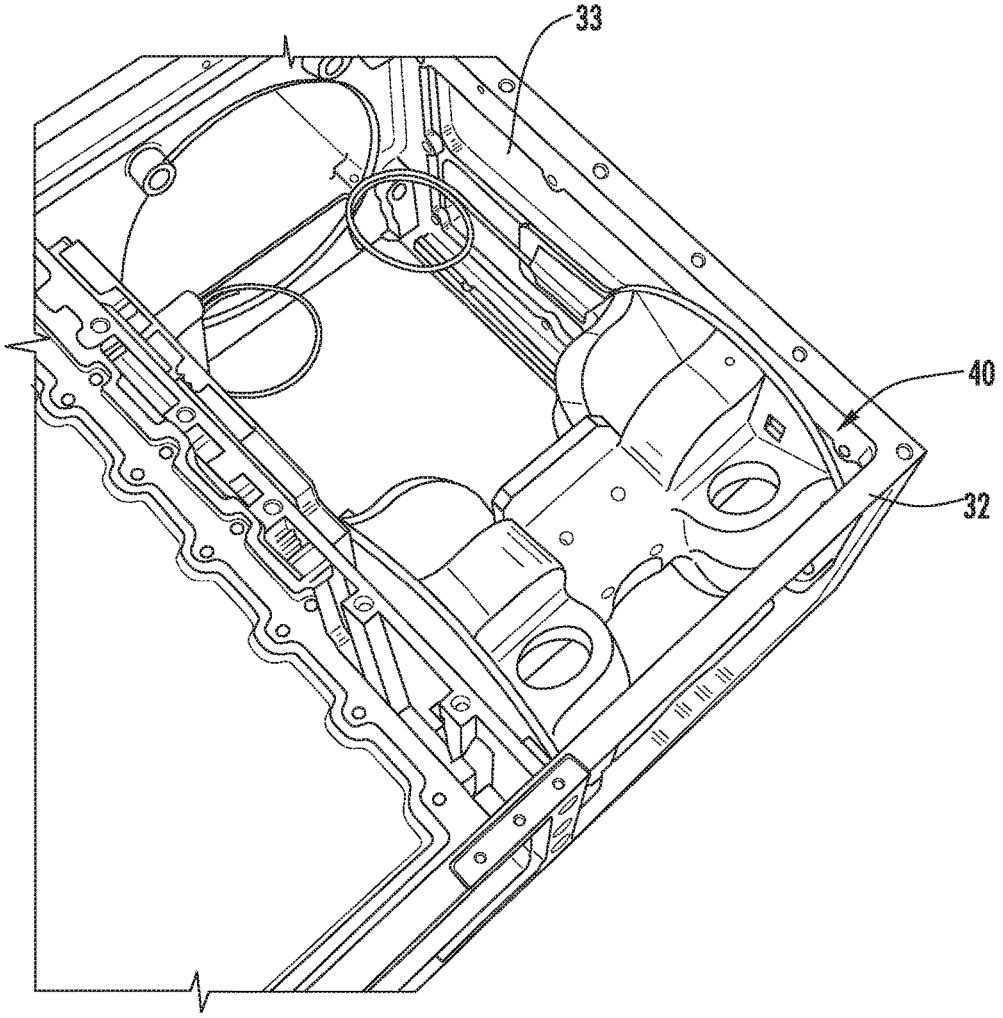
FIG. 4 is a top view of the antenna storage compartment of the satellite housing of the satellite of FIG. 1 with the antenna of FIG. 2 therein in a stowed or non-deployed position.
Figure 5:
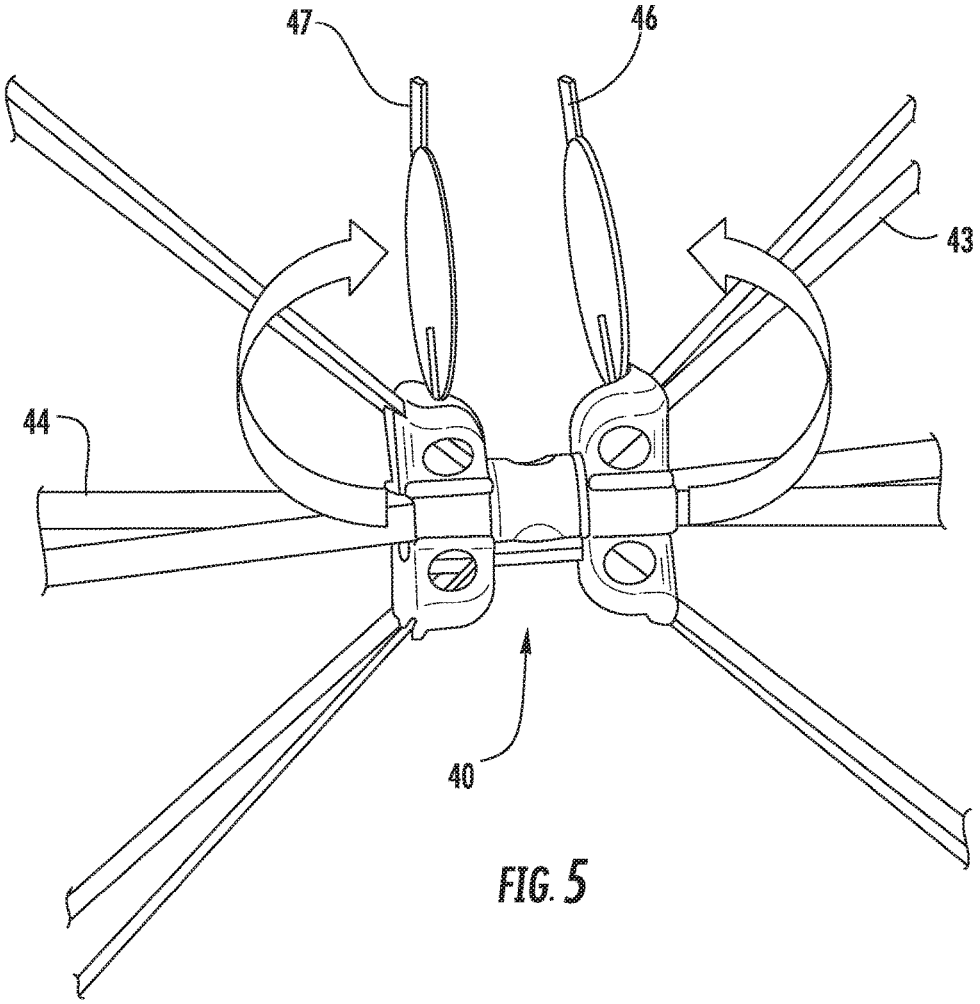
FIG. 5 is side view of the housing of the antenna of FIG. 2 showing the antenna element covers in an open position after deployment of the antenna elements.

The antenna is electrically coupled to the RF circuitry 34 and carried within the antenna storage compartment 33 during launch. The antenna housing 40 illustratively includes first and second opposing antenna element storage compartments 41, 42. The antenna 31 further illustratively includes a first plurality of self-deploying conductive antenna elements 43 moveable between a first stored or stowed position within the first antenna element storage compartment (see FIG. 3), and a first deployed position extending outwardly from the canister and defining a first conical antenna (see FIG. 2). The antenna 31 may also include a second plurality of self-deploying conductive antenna elements 44 moveable between a second stored position within the second antenna element storage compartment (FIG. 3), and a second deployed position extending outwardly from the canister and defining a second conical antenna (FIG. 2). The first and second conical antennas 43, 44 may extend in opposing directions and define a biconical antenna when in the first and second deployed positions, as shown in FIGS. 1 and 2.

As a result of the stowability and relatively compact size of the antenna 31, the satellite 30 may be implemented as a small or miniaturized satellite (SmallSat) in some embodiments, which advantageously allows for more economical launch vehicles to be used to place the satellite in orbit. However, the antenna 31 may be incorporated in larger satellites as well, and deployed using a variety of platforms (rockets, space shuttles, etc.) in different embodiments.

In the illustrated example, the antenna elements 43, 44 are metallic tape segments which are rolled or coiled within respective cylindrical cavities 45 within the first and second opposing antenna element storage compartments 41, 42, as will be discussed further below. The antenna housing 40 further illustratively includes a first removable cover or lid 46 associated with the first antenna element storage compartment 41, and a second removable cover or lid 47 associated with the second antenna element storage compartment 42. The first and second removable covers 46, 47 are attached to the first and second storage compartments 41, 42 via respective hinges 48, 49 (e.g., spring-loaded hinges).

The tape elements 43, 44 are constrained for stowage by the hinged covers 46, 47, which are allowed to open as the mast 35 is extended and the antenna housing 40 leaves the antenna storage chamber 33 to release the coiled tape elements to extend to their deployed positions. That is, when the covers 46, 47 are free from their restraint by the antenna storage chamber 33, the spring biased hinges 48, 49 force them open, allowing free deployment of the individual tape elements 43, 44. This passive deployment configuration advantageously does not require power for activation of actuators, etc. Yet, in some embodiments, powered actuators may be used to deploy the elements 43, 44, as well as a burn wire or other release device to release the covers 46, 47 to open at the desired time.

Figure 6:
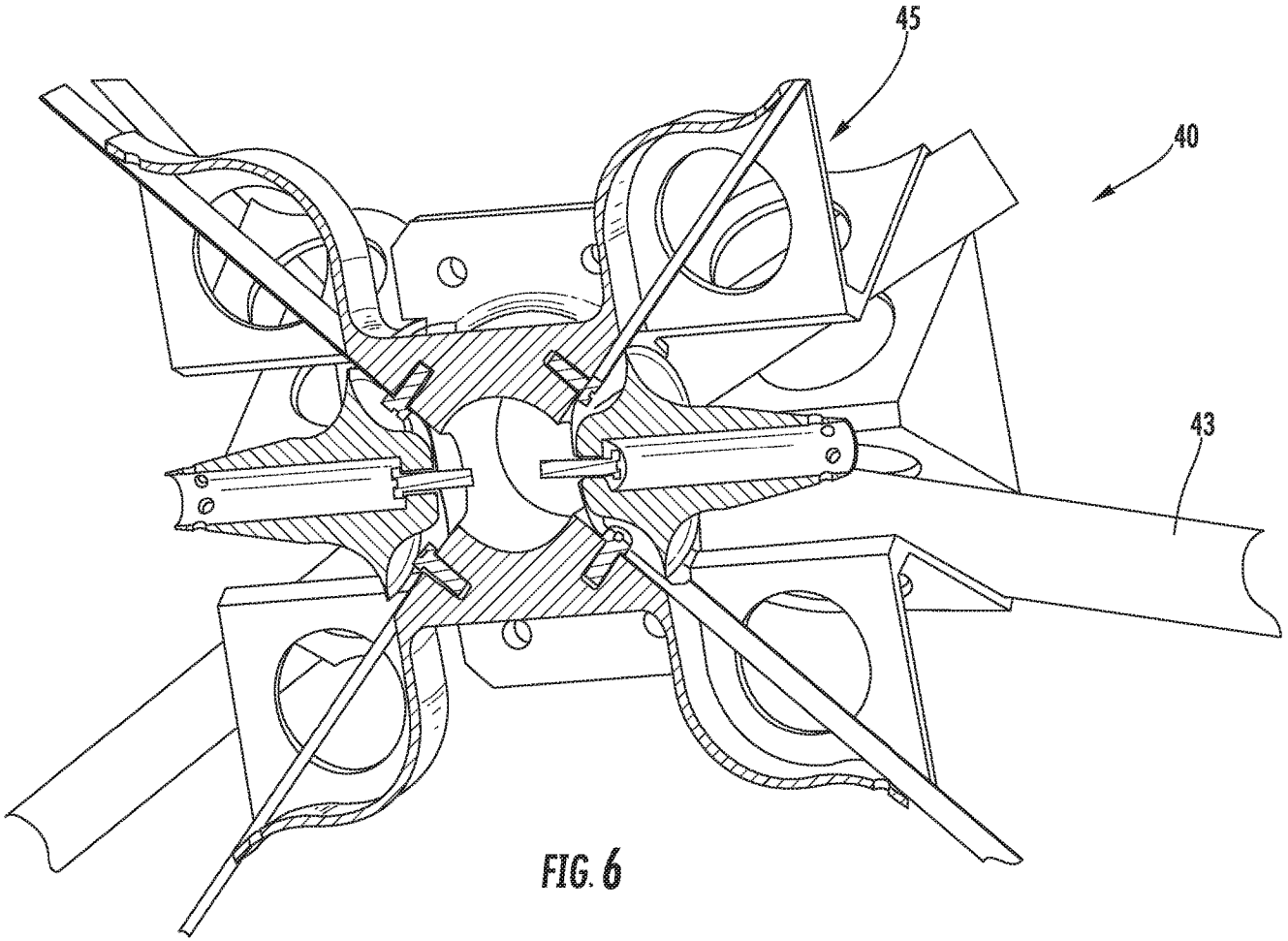
FIG. 6 is a perspective sectional view of the antenna housing showing the antenna elements within the antenna element storage compartment in a deployed position.

In the example embodiment illustrated in FIG. 6, a continuous piece of metal tape is used to create two antenna elements. This advantageously helps to reduce discontinuity in the construction process, although separate segments may be used for each antenna elements 43, 44 in different embodiments. The metal tape may be similar to that found in tape rulers, for example, although different types of metals and configurations may be used in different embodiments. That is, the antenna elements 43, 44 need not always be flat or tape shaped. The antenna elements may be painted or coated, if desired, although it may generally be desirable to have bare metal at electrical contact points.

Figure 7B:
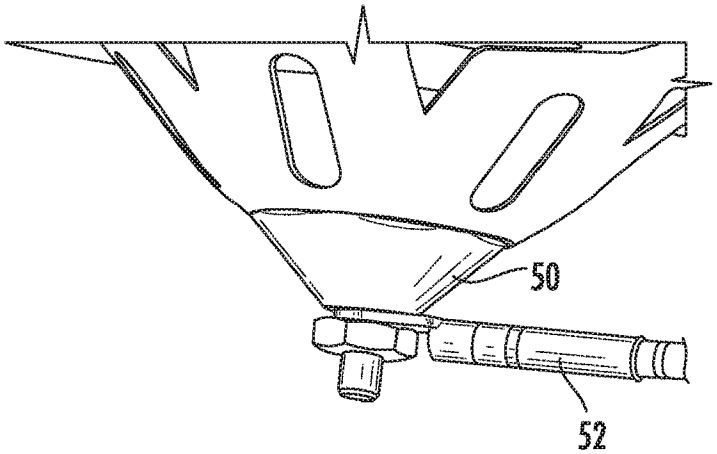
FIG. 7B is a perspective view of a conductive feed cone of the antenna housing of FIG. 2.
Figure 7A:
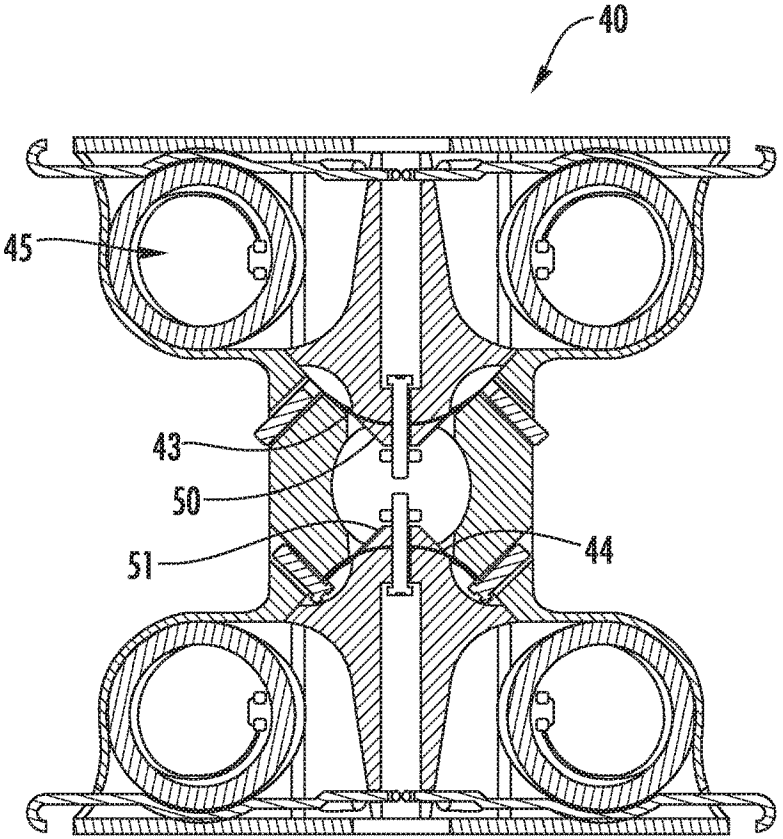
FIG. 7A is a cross-sectional view of the housing of the antenna of FIG. 2
Figure 8:
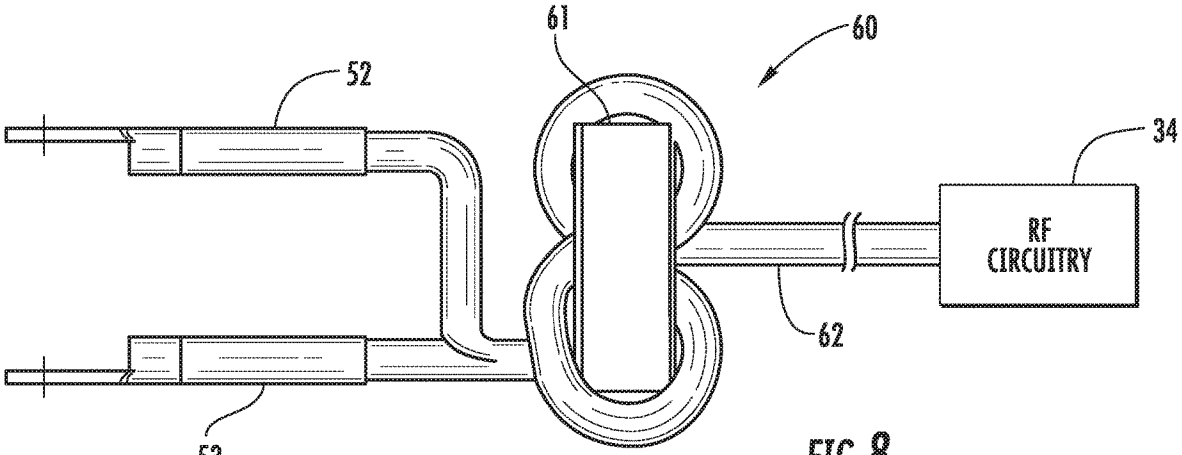
FIG. 8 is a side view of an example balun feed assembly which may be used with the antenna of FIG. 2.
Figure 9:
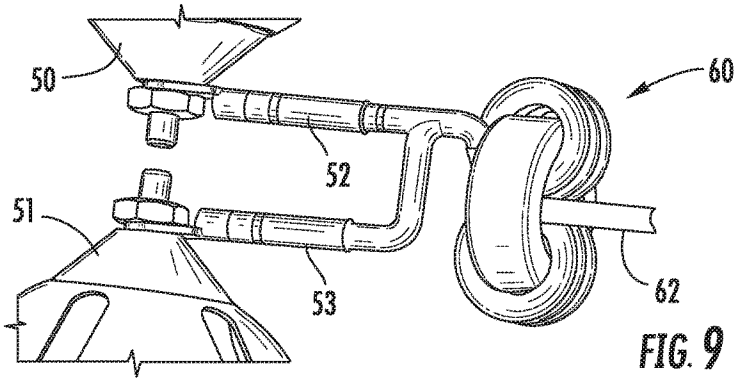
FIG. 9 is a perspective view of the balun feed assembly of FIG. 8 after connection to the conductive feed cones.

In accordance with one example implementation, the antenna housing 40 may be 3D printed from a dielectric material, although other techniques may be used for fabricating the housing as well. Furthermore, as shown in the example of FIGS. 7A and 7B, a first conductive feed cone 50 is coupled to the first plurality of antenna elements 43 at a first apex thereof, and a second conductive feed cone 51 is coupled to the second plurality of antenna elements 44 at a second apex. Thus, when in their deployed or extended positions, the antenna elements 43, 44 define conical antennas with their respective conductive feed cones 50, 51. The tape elements 43, 44 are also connected in parallel to the cones 50, 51. The conical spreader structure advantageously spreads currents evenly to the tape elements 43, 44 to create a horn structure, and advantageously helps provide a broadband impedance match. The tape elements 43, 44 may be of different lengths in some embodiments. For instance with a tall skinny conical cage the inclusion of shorter tape elements 43, 44 may improve resonance on even harmonic frequencies.

Not only do the conical metal tips or cones 50, 51 complete the cone shape at the convergence point of the respective conical antennas, they also advantageously provide ready attachment points for feed cables 52, 53. In the example illustrated in FIGS. 8 and 9, a balun 60 is coupled to the first and second conductive feed cones 50, 51 via the feed cables 52, 53, respectively. More particularly, the balun 60 illustratively includes a circular ferrite core 61 wrapped with a coaxial cable 62. Generally speaking, the balun 60 may be placed as close to the convergence point between the cones 50, 51 as is feasible. Furthermore, the coaxial cable 62 is wrapped around the circular ferrite core 61 in a serpentine fashion as shown, although other configurations may be used in different embodiments. More particularly, the center conductor of the coaxial cable 62 may be coupled to the feed line 52, and the shield conductor may be connected to the feed line conductor 53 (or vice-versa). In an example embodiment, the balun 60 may advantageously provide broad bandwidth cable current suppression from 50 to 1000 MHz with a magnitude Z>200 Ohms. The serpentine winding of balun 60 advantageously places the coax cable entry and exit points on opposite ends of the toroid reducing stray capacitance between turns. The Q or impedance developed in a resonant circuit is increased by maximizing LC ratio, e.g. maximizing inductance relative capacitance. So the balun 60 provides maximum broadband common mode choking impedance by the reduced interwinding capacitance of the serpentine winding embodiment. Relative a conventional helical winding the serpentive winding of balun 60 in testing had increased self-resonance frequency relative a helical winding.

In the example implementation shown in FIGS. 1 and 2, the first and second conical antennas (and thus the "cages" of antenna elements 43, 44) are rotationally offset, or "clocked", with respect to one another. The difference between unclocked and clocked antenna element configurations is shown FIGS. 10 and 11. More particularly, in the side and top views of FIGS. 10(*a*) and 10(*b*), the three upper antenna elements 43 are rotationally or vertically aligned with the three lower antenna elements 44. That is, the upper elements 43 are directly above the lower elements 44 with no rotational offset. The resulting simulated in the H field plane radiation pattern 70 for this unclocked configuration is shown in FIG. 10(*c*).

In the side and top views of FIGS. 11(*a*) and 11(*b*), the three upper antenna elements 43 are rotationally or vertically offset with the three lower antenna elements 44. That is, the upper elements 43 are not directly above the lower elements 44, so that in the top view of FIG. 11(*b*) both sets of antenna elements are visible. The resulting simulated radiation pattern 71 for this unclocked configuration is shown in FIG. 11(*c*). Comparison of the radiation patterns 70, 71 demonstrates that rotating or clocking the antenna elements 43, 44 helps to "smooth" the radiation pattern. More specifically, 27 dB of pattern ripple is present without clocking, as compared with 8 dB of pattern ripple with clocking. Thus, using a clocked configuration may advantageously allow fewer antenna elements 43, 44 to be used to achieve desired performance, yet with lighter weight and lower cost, although unclocked configurations may also be used in certain embodiments. By way of example, the amount of clocking may be selected so that the antenna elements 43, 44 are radially spaced equal distances from one another. In the example of FIG. 2, there are six elements 43 and six elements 44 spaced 30° from one another. That is, the elements 43 are 60° apart from one another, and the elements 44 are offset 60° from one another, and the two arrays of elements are offset 30° from each other.

Figure 13:
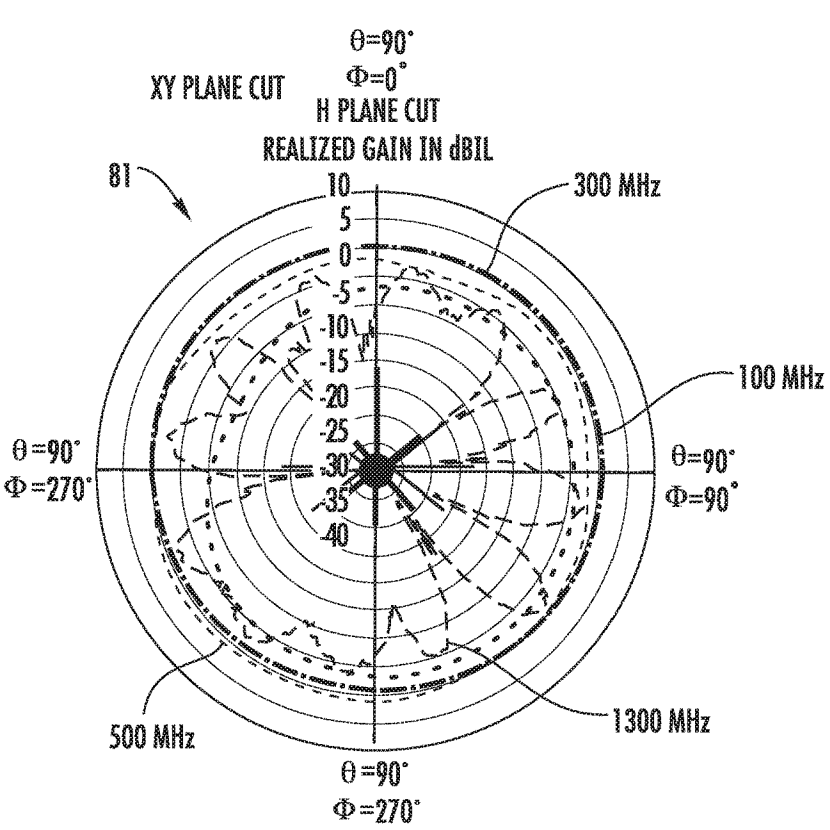
FIGS. 12 and 13 are measured radiation patterns for the antenna of FIG. 10(*a*) is accordance with an example embodiment.
Figure 12:
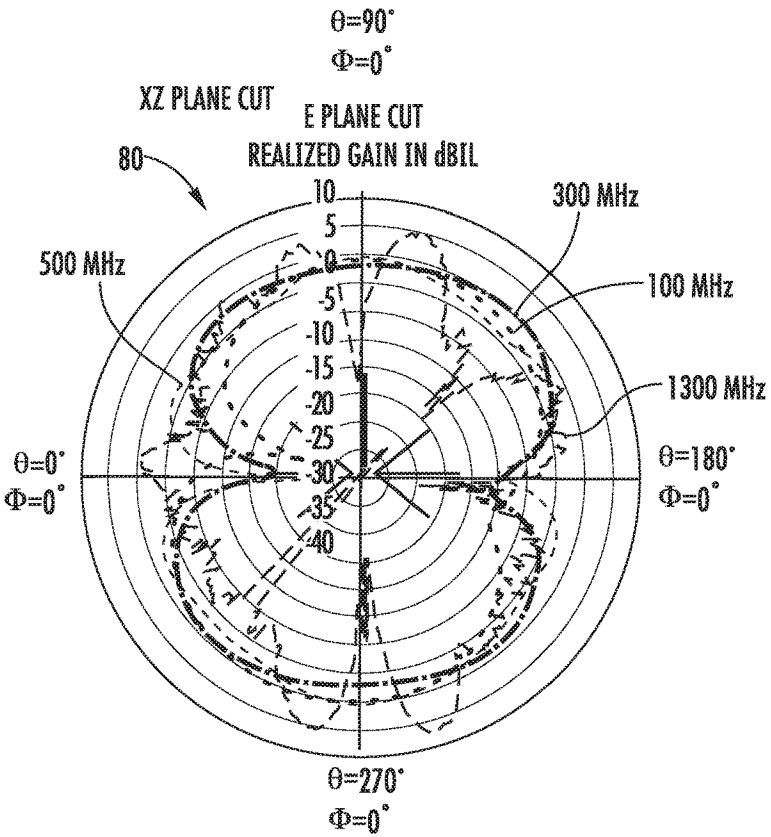
Figure 15:
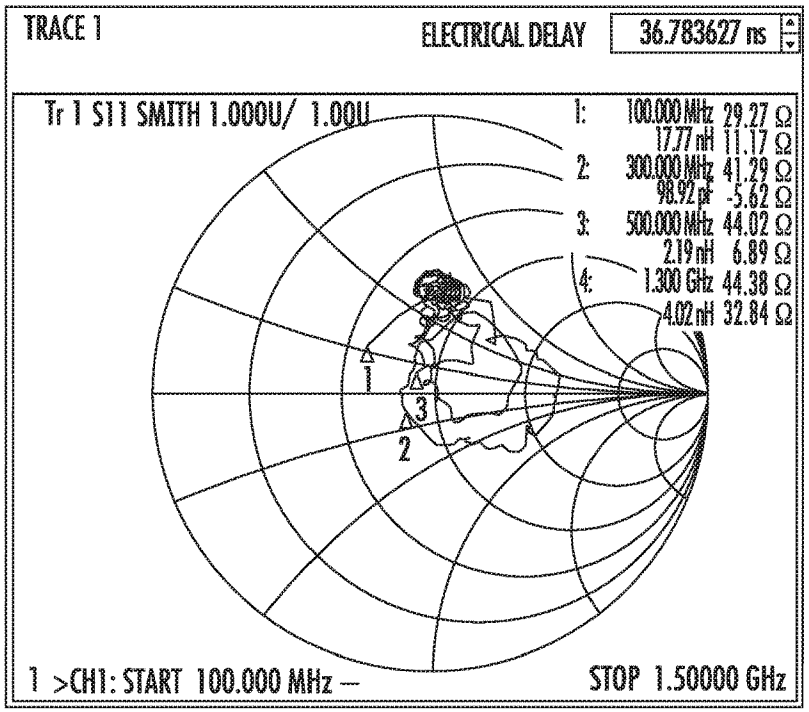
FIGS. 14 and 15 are graphs of measured radiation patterns for an example implementation of the antenna of FIG. 10(*a*) for omnidirectional azimuth and sine elevation shapes, respectively.
Figure 14:
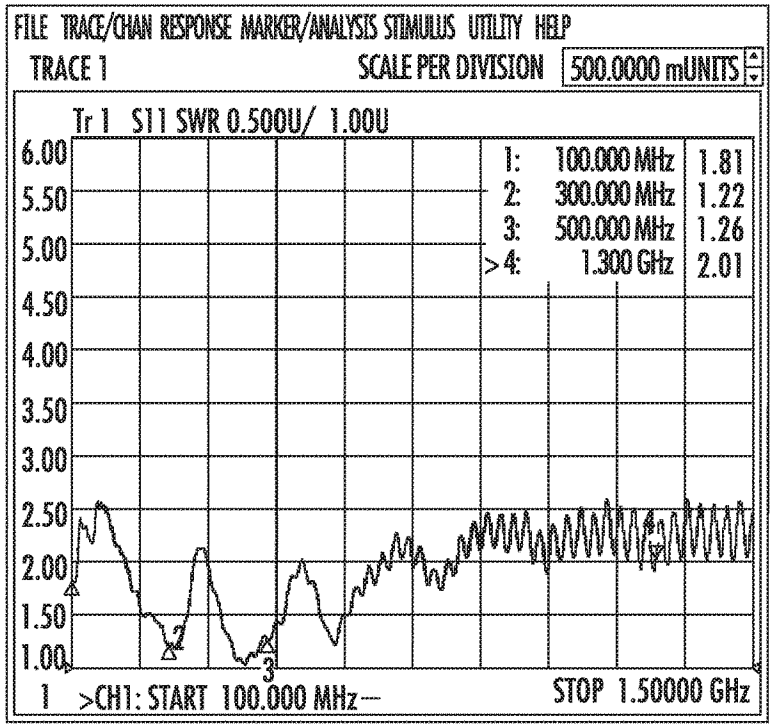
Figure 17:
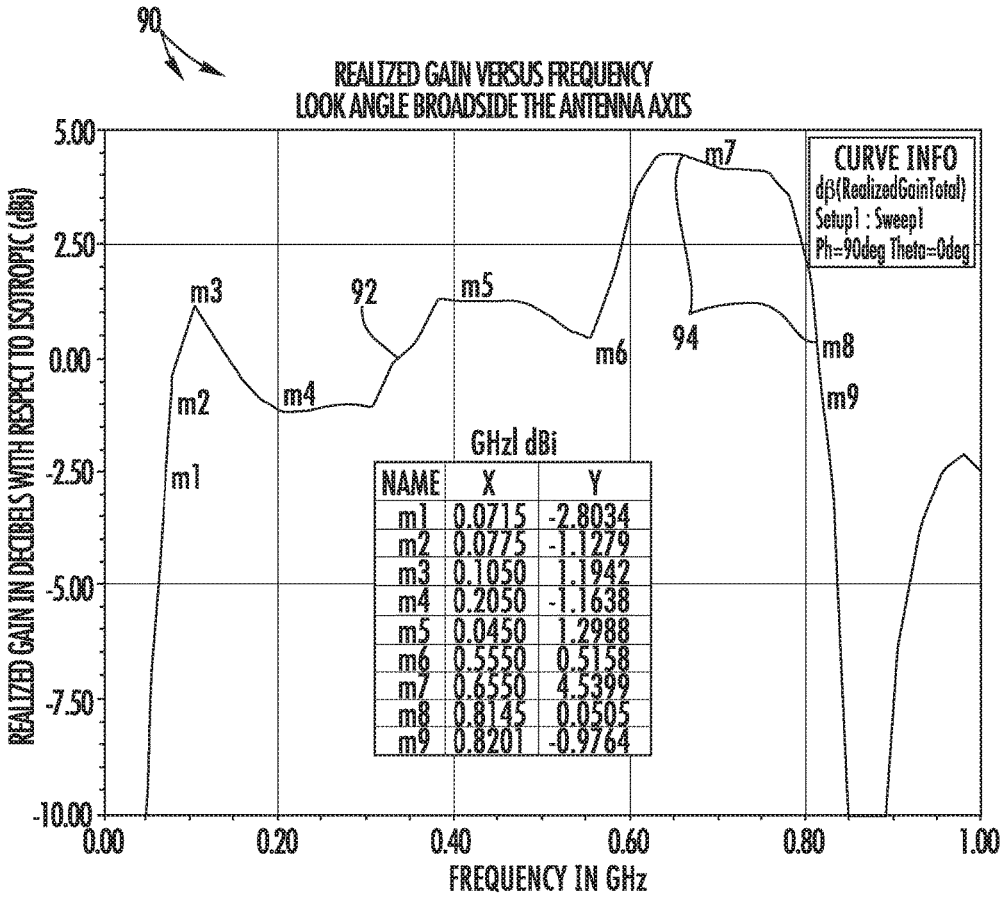
FIG. 17 is a graph depicting the realized gain response versus frequency at a look angle broadside the antenna mechanical axis.

Measured radiation patterns for the unclocked element configuration shown in FIGS. 10(*a*) and 10(*b*) for the omnidirectional azimuth cut shape and the sine shaped elevation cut shape are shown in the graphs 80, 81 of FIGS. 12 and 13, respectively. For the test configuration, linear polarization and a co-polarized source were used at a far field distance of forty-three feet. Furthermore, the graphs 85, 86 of FIGS. 14 and 15 show measured VSWR and vector impedance for this test configuration, respectively. From the graphs 85, 86 it will be seen that matching losses are under 25% over a relatively large bandwidth of 100 to 1500 MHz. FIG. 17 graph 90 trace 92 depicts the simulated for realized gain response versus frequency at a look angle broadside the antenna mechanical axis of $\theta=90°$ and $\phi=0°$. FIG. 17 units are in dBi or decibels with respect to an isotropic antenna. The lower 3 dB cutoff, defined as 3 dB down from lowest frequency localized gain maxima, occurred at 72 MHz. Harmonic responses providing gain increases can be seen a 405 and 655 Mhz.

It should be noted that different numbers of upper and lower elements 43, 44 may be used in different embodiments. In the example of FIGS. 10 and 11 there are three of each (six total antenna elements), and in the embodiment shown in FIGS. 1 and 2 six each (twelve total antenna elements). However, more or less elements may be used depending upon the size, weight, and power (SWaP) and performance requirements of a given implementation, for example.

Specifications for a FIGS. 10(*a*) and 10(*b*) prototype of the antenna are provided in the following table:

| Parameter | Specification | Comments |
|---|---|---|
| Antenna Type | Space deployable broadband dipole, receive only | |
| Number of tape elements 43, 44 total | 12 | 6 elements per conical cage |
| Tape element material | Stanley PowerLock ® 12 foot tape measures, P/N 33-212 | |
| Tape element 43, 44 lengths | 27 inches | |
| Antenna overall diameter | 38 inches | |
| Antenna total height | 40 inches | 0.27 wavelengths at 80 MHz lower cutoff |
| Stowed height | 3.75 inches | |
| Stowed diameter | 3.55 inches | Fits in 1U (10 cm × 10 cm × 10 cm) satellite envelope |
| Weight stowed | 0.71 pounds | |
| Weight deployed | 0.71 pounds | |
| Half cone angle α | 450 | Measured between cone axis and conical cage wall |
| Gap between cone points at center | 0.5 inches | |
| Clocking | No clocking this embodiment | Clocking reduces H plane radiation pattern ripple |
| Nominal frequency range | 80 to 820 MHz | >0 dBi realized gain throughout this frequency range |
| Realized gain | 4.5 dBi | At peak look angle and peak frequency |
| VSWR | Under 6 to 1 over 80 to 820 Mhz | |
| Azimuth radiation pattern/H plane cut | Omnidirectional with + − 2 dBi ripple | |
| Elevation radiation pattern/E plane cut | Sine θ | |
| Elevation plane 3 dB beamwidth | 89 degrees | At 80 Mhz |
| Polarization | Linear | |
| Ground | Ground independent | Satellite chassis not needed to form radiation pattern |
| Balun | 6 turn winding of RG-178 coaxial cable on toroidal core | 1 to 1 impedance ratio |
| Balun winding | Special banked serpentine | |
| Balun core | Micrometals FT-50-43 ferrite toroid | Initial relative permeability $\mu_r$ = 850 |

The cone half angle α provides a trade between antenna size, stowed antenna size, and driving point resistance. A cone half angle α of 45 degrees provides a driving point resistance at between the conical cage driving points (center gap) of about 105 ohms and a fatter cone angle α of 68 degrees a driving resistance of nearly 50 ohms. Conversely, the smaller half cone angle means the stowed (RF) antenna size 31 is smaller as the antenna housing 40 is smaller in diameter.

Figure 16:
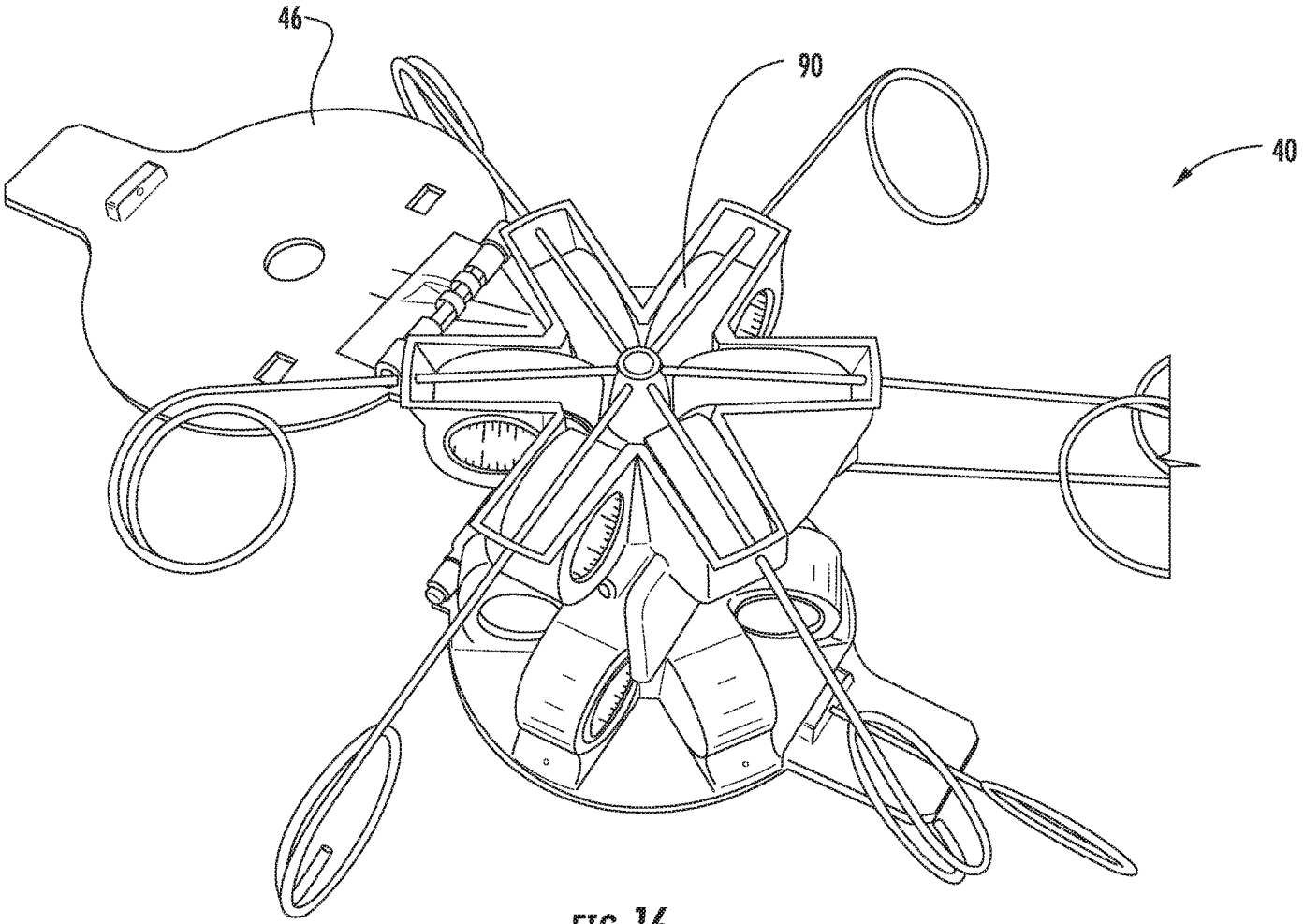
FIG. 16 is a perspective view of the housing of the antenna of FIG. 2 during the assembly process with safety pins inserted to hold the antenna elements in place during the assembly process.

Referring additionally to FIG. 16, a related method for making the RF satellite antenna 31 is now described. The method may include installing the first plurality of self-deploying conductive antenna elements 43 within the first antenna element storage compartment 41, and installing the second plurality of self-deploying conductive antenna elements 44 within the second antenna element storage compartment 42. In the illustrated example, a plurality of safety pins or rods 90 are inserted as the coiled elements 43 are positioned within the first and second storage compartments 41, 42 to hold the elements in place until the covers 46, 47 are closed. The pins 90 may then be removed once the covers 46, 47 are in place to hold the elements 43, 44 in place. The assembled antenna housing 40 may then be inserted within the antenna storage compartment 33 and connected to the mast 35 in preparation for deployment of the satellite 30.

Different length self-deploying conductive antenna elements 43 are contemplated for the present invention for response tuning. Different take off angles for the self-deploying conductive antenna elements 43 are contemplated for impedance and radiation pattern adjustment. Multiple nested conical cages may allow for different frequency bands of operation and smaller skinnier conical cages. In this regard, U.S. Pat. No. 7,170,461 is hereby incorporated herein in its entirety by reference.

A theory of operation for the radio frequency (RF) antenna 31 follows, (RF) antenna 31 structure provides a dipole type antenna due to divergence (and convergence) electric currents on the self-deploying conductive antenna elements 43, 44. The self-deploying conductive antenna elements 43, 44 form a cage approximation to solid upper and lower cones and a self-exciting TEM mode biconical horn antenna. The conical cages provide a uniformly tapered transmission line to match between the 377 ohm load impedance of free space radiated waves and the 50 ohm (or other) circuit driving impedance at the antenna terminals. The current distribution along the structure is a cosine standing wave near the lower cutoff frequency and E plane radiation pattern is sine shape. Antenna radiation patterns are the Fourier transforms of current distributions. The resulting radiation is a spherically expanding wave described by Hankel functions. Geometrically, the wave "fits" the conical cage walls over a wide range of frequency. The higher the frequency the closer to the horn throat and the conical spreaders the wave may launch.

The lower cutoff frequency is a function of antenna 31 physical length. For a 45 degree half cone angle α the lower half power cutoff, a defined by 50% of the energy reflecting out of the antenna at 6 to 1 VSWR, occurs at 0.29 wavelengths antenna height in a 50 ohm system. The upper cutoff, or maximum usable frequency is related to conical cage angles and the proximity of the conical cage points with closer points providing operation at higher frequencies. A driving point gap of λ/30 or less has been sufficient at the conical cage points for low driving reflection and VSWR.

Figure 18:
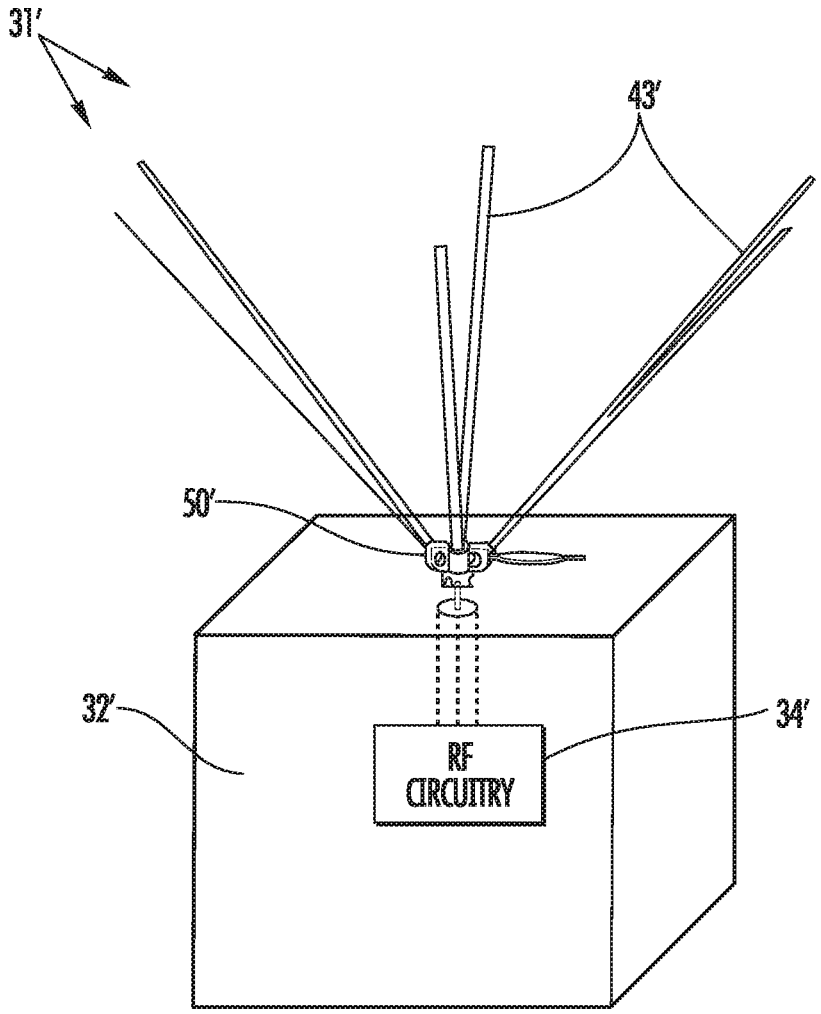
FIG. 18 is an isometric view of a reduced size a stowable bi-conical antenna incorporating a satellite chassis radiating portion.

An alternative embodiment of the stowable or storable radio frequency (RF) antenna is depicted in FIG. 18 as storable half portion radio frequency (RF) antenna 31'. In half portion embodiment a smaller stowable or storable radio frequency (RF) antenna 31' is provided as an electrically conductive satellite chassis 32' forms an electrically driven antenna portion and a second plurality of self-deploying conductive antenna elements are not used. Two antenna portions are provided which include: 1) a single conductive feed cone 50' with is attached to the tape elements 43' and; 2) the satellite chassis 32'. A coaxial feed terminal 52' may extend from the satellite chassis 32' to form the electrical connection to the single conductive feed cone 50' and coaxial cable may extend into the electrically conductive satellite chassis 32' to connect to RF circuitry 34'. The radiation pattern of the smaller stowable or storable radio frequency (RF) antenna 31' is a function of both electrically conductive satellite chassis 32' characteristics as well as the plurality of self-deploying conductive antenna elements 43' characteristics, so an assymetric dipole may be formed. Solar cells (not shown) which may cover the electrically conductive satellite chassis 32' are in the current art sufficiently electrically conductive for the purposes of antenna radiation, and the electrically conductive satellite chassis 32' may even be a solar cell panel. A balun (balun) may not be needed with the smaller stowable or storable radio frequency (RF) antenna 31' as there is no need to control coax cable common mode currents due to the shielding effect of the electrically conductive satellite chassis 32', although a balun may be used if desired. In the storable half portion radio frequency (RF) antenna 31' the deliberate intent is to cause satellite chassis radiation.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that other modifications and embodiments are intended to be included within the scope of the appended claims.

That which is claimed is:

1. A radio frequency RF satellite antenna comprising: a radio frequency RF antenna housing to be carried by the satellite and comprising first and second opposing antenna element storage compartments; a first plurality of self-deploying conductive antenna elements moveable between a first stored position within the first antenna element storage compartment, and a first deployed position extending outwardly from a canister and defining a first conical antenna; and a second plurality of self-deploying conductive antenna elements moveable between a second stored position within the second antenna element storage compartment, and a second deployed position extending outwardly from the canister and defining a second conical antenna; the first and second conical antennas extending in opposing directions and defining a biconical antenna when in the first and second deployed positions, a satellite housing having an antenna storage compartment therein; radio frequency (RF) circuitry carried by the satellite housing; an mast having a proximal end coupled to the satellite housing and a distal end, the mast being moveable between a stored position where the distal end is within the antenna storage compartment and a deployed position where the distal end is spaced apart from the satellite housing; and a radio frequency (RF) satellite antenna coupled to the RF circuitry and comprising an antenna housing carried within the antenna storage compartment and coupled to the distal end of the mast and comprising first and second opposing antenna element storage compartments, a first plurality of self-deploying conductive antenna elements moveable between a first stored position within the first antenna element storage compartment, and a first deployed position extending outwardly from the canister and defining a first conical antenna when the mast is moved to its deployed position, and a second plurality of self-deploying conductive antenna elements moveable between a second stored position within the second antenna element storage compartment, and a second deployed position extending outwardly from the canister and defining a second conical antenna when the mast is moved to its deployed position, the first and second conical antennas extending in opposing directions and defining a biconical antenna when in the first and second deployed positions.

2. The RF satellite antenna of claim 1 wherein the first plurality of antenna elements each comprises a first metallic tape segment; and wherein the second plurality of antenna elements each comprises a second metallic tape segment.

3. The RF satellite antenna of claim 1 further comprising a first removable cover associated with the first antenna element storage compartment, and a second removable cover associated with the second antenna element storage compartment.

4. The RF satellite antenna of claim 1 wherein the first and second conical antennas are rotationally offset with respect to one another.

5. The RF satellite antenna of claim 1 further comprising:

a first conductive feed cone coupled to the first plurality of antenna elements at a first apex; and a second conductive feed cone coupled to the second plurality of antenna elements at a second apex.

6. The RF satellite antenna of claim 1 further comprising a balun coupled to the first and second conductive feed cones.

7. The RF satellite antenna of claim 1 further comprising a mast mounting flange coupled to the antenna housing.

8. The RF satellite antenna of claim 1 wherein the first plurality of antenna elements comprises at least three first antenna elements; and wherein the second plurality of antenna elements comprises at least three second antenna elements.

9. A satellite comprising: a satellite housing having an antenna storage compartment therein; radio frequency (RF) circuitry carried by the satellite housing; a mast having a proximal end coupled to the satellite housing and a distal end, the mast being moveable between a stored position where the distal end is within the antenna storage compartment and a deployed position where the distal end is spaced apart from the satellite housing; and a radio frequency (RF) satellite antenna coupled to the RF circuitry and comprising an antenna housing carried within the antenna storage compartment and coupled to the distal end of the mast and comprising first and second opposing antenna element storage compartments, a first plurality of self-deploying conductive antenna elements moveable between a first stored position within the first antenna element storage compartment, and a first deployed position extending outwardly from a canister and defining a first conical antenna when the mast is moved to its deployed position, and a second plurality of self-deploying conductive antenna elements moveable between a second stored position within the second antenna element storage compartment, and a second deployed position extending outwardly from the canister and defining a second conical antenna when the mast is moved to its deployed position, the first and second conical antennas extending in opposing directions and defining a biconical antenna when in the first and second deployed positions.

10. The satellite of claim 9 wherein the first plurality of antenna elements each comprises a first metallic tape segment; and wherein the second plurality of antenna elements each comprises a second metallic tape segment.

11. The satellite of claim 9 wherein the RF satellite antenna further comprises a first removable cover associated with the first antenna element storage compartment, and a second removable cover associated with the second antenna element storage compartment.

12. The satellite of claim 9 wherein the first and second conical antennas are rotationally offset with respect to one another.

13. The satellite of claim 9 wherein the RF satellite antenna further comprises:

a first conductive feed cone coupled to the first plurality of antenna elements at a first apex; and a second conductive feed cone coupled to the second plurality of antenna elements at a second apex.

14. The satellite of claim 9 wherein the RF satellite antenna further comprises a balun coupled to the first and second conductive feed cones.

15. The satellite of claim 9 wherein the RF satellite antenna further comprises a mast mounting flange coupled to the proximal end of the mast.

16. The satellite of claim 9 wherein the first plurality of antenna elements comprises at least three first antenna elements; and wherein the second plurality of antenna elements comprises at least three second antenna elements.

17. A method for making a radio frequency (RF) satellite antenna comprising: in an antenna housing to be carried by a satellite and comprising first and second opposing antenna element storage compartments, installing a first plurality of self-deploying conductive antenna elements moveable between a first stored position within the first antenna element storage compartment, and a first deployed position extending outwardly from a canister and defining a first conical antenna; and installing a second plurality of self-deploying conductive antenna elements moveable between a second stored position within the second antenna element storage compartment, and a second deployed position extending outwardly from the canister and defining a second conical antenna; the first and second conical antennas extending in opposing directions and defining a biconical antenna when in the first and second deployed positions.

18. The method of claim 17 wherein the first plurality of antenna elements each comprises a first metallic tape segment; and wherein the second plurality of antenna elements each comprises a second metallic tape segment.

19. The method of claim 17 further comprising positioning a first removable cover over the first antenna element storage compartment, and a second removable cover over the second antenna element storage compartment.

20. The method of claim 17 wherein the first and second conical antennas are rotationally offset with respect to one another.

21. The method of claim 17 further comprising coupling a balun to the first and second conductive feed cones.

* * * * *